US009537261B2

(12) United States Patent
Chen et al.

(10) Patent No.: US 9,537,261 B2
(45) Date of Patent: Jan. 3, 2017

(54) PORT CONNECTOR WITH CAPABILITY OF DUAL MATING ORIENTATION

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Fu-Yi Xu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/919,740

(22) Filed: Oct. 22, 2015

(65) Prior Publication Data

US 2016/0134055 A1 May 12, 2016

(30) Foreign Application Priority Data

Nov. 6, 2014 (CN) ..... 2014 1 0618493

(51) Int. Cl.
*H01R 13/642* (2006.01)
*H01R 12/72* (2011.01)

(52) U.S. Cl.
CPC ..... *H01R 13/642* (2013.01); *H01R 12/722* (2013.01)

(58) Field of Classification Search
USPC ..... 439/217, 218, 83, 658, 660; 174/359
See application file for complete search history.

(56) References Cited

U.S. PATENT DOCUMENTS 8,801,462 B2 * 8/2014 Tsai ..... H01R 12/724 439/607.01
9,281,582 B2 * 3/2016 Hou ..... H01R 12/707
2011/0263141 A1 * 10/2011 Ko ..... H01R 12/707 439/83
2011/0312200 A1 * 12/2011 Wang ..... H01R 12/724 439/218
2012/0015561 A1 1/2012 Tsai
2012/0149244 A1 * 6/2012 Zheng ..... G02B 6/3817 439/658
2014/0206209 A1 * 7/2014 Kamei ..... H01R 24/60 439/81
2014/0335729 A1 * 11/2014 Little ..... H01R 24/60 439/607.53
2015/0072562 A1 * 3/2015 Little ..... H01R 13/6658 439/607.55

FOREIGN PATENT DOCUMENTS

TW M481525 U 7/2014
TW M506400 U 8/2015

* cited by examiner

*Primary Examiner* — Alexander Gilman

(74) *Attorney, Agent, or Firm* — Winston Hsu; Scott Margo

(57) ABSTRACT

A port connector includes a port shell disposed inside the port shell, a housing base and a port contact set. The housing base includes a main base and a tongue structure. The tongue structure extends from the main base and has a first face and a second face opposite to the first face. The port contact set is mounted with the housing base. At least one port contact of the port contact set includes a main body installed inside the main base, a foot portion, a first end portion and a second end portion. The foot portion extends from the main body and stretches out of the main base. The first end portion protrudes from the main body and is exposed from the first face. The second end portion corresponding to the first end portion protrudes from the main body and is exposed from the second face.

11 Claims, 9 Drawing Sheets

PORT CONNECTOR WITH CAPABILITY OF DUAL MATING ORIENTATION

BACKGROUND OF THE INVENTION

1. Field of the Invention

The present invention relates to a port connector, and more particularly, to a port connector with capability of dual mating orientation.

2. Description of the Prior Art

With development of computer and peripheral equipment industry, a Universal Serial Bus (USB) interface has become one of important interfaces for communication and data transmission between a computer and peripheral equipment. A USB connector usually has a specified orientation when mating, i.e., a tongue of a USB male connector and a USB female connector are staggered, such that the tongue of the USB male connector is able to be inserted into a socketing space surrounded by a metal shell of the USB female connector. It ensures that the USB male connector is inserted into the female connector properly and that terminals of the USB male connector are electrically connected to terminals of the USB female connector, which achieves a purpose of communication and data transmission. In other words, the conventional USB connector has only single mating orientation. As a result, the USB male connector and the USB female connector have to be oriented before mating, such that the USB male and female connectors are able to be coupled with each other. In such a way, the conventional USB connector is not convenient in use.

SUMMARY OF THE INVENTION

The present invention provides a port connector adapted for Universal Serial Bus (USB) interface and with capability of dual mating orientation for solving the above-mentioned drawbacks.

According to the claimed invention, a port connector with capability of dual mating orientation includes a port shell, a housing base, and a port contact set. The housing base is disposed inside the port shell. The housing base includes a main base and a tongue structure. The tongue structure extends from the main base and has a first face and a second face opposite to the first face. The port contact set is mounted with the housing base. At least one port contact of the port contact set includes a main body, a foot portion, a first end portion and a second end portion. The main body is installed inside the main base. The foot portion extends from the main body and stretches out of the main base. The first end portion protrudes from the main body and is exposed on the first face. The second end portion corresponding to the first end portion protrudes from the main body and is exposed on the second face.

According to the claimed invention, an assembling slot is formed on the main base and for installing the main body. A first notch is formed on the first face of the tongue structure and for accommodating the first end portion. A second notch is formed on the second face of the tongue structure and for accommodating the second end portion, and the assembling slot communicates with the first notch and the second notch.

According to the claimed invention, a bottom face of the first notch, a bottom face of the second notch, and a lateral wall of the assembling slot cooperatively define a partition structure. A holding slot is defined between the first end portion and the second end portion. When the main body is installed inside the assembling slot, the first end portion enters into and is accommodated inside the first notch via the assembling slot, the second end portion enters into and is accommodated inside the second notch via the assembling slot, and the holding slot holds the partition structure.

According to the claimed invention, the main body includes at least one embedding structure, and the at least one embedding structure embeds a lateral wall of the assembling slot when the main body is installed inside the assembling slot.

According to the claimed invention, the at least one embedding structure is selectively disposed on a side of the main body or on two opposite sides of the main body.

According to the claimed invention, the at least one embedding structure is a substantially trapezoidal structure.

According to the claimed invention, a chamfering structure is formed on a corner of the first end portion and away from the main body and the second end portion, and a guiding structure is formed on a corner of the second end portion and away from the main body and the first end portion.

According to the claimed invention, the foot portion is a dual in-line packaged structure or a surfaced mounted structure.

According to the claimed invention, the port contact set includes a first port contact and a second port contact, and a length of a foot portion of the first port contact is longer than a length of a foot portion of the second port contact.

According to the claimed invention, the port shell includes a main housing and at least one fixing lug, and the at least one fixing lug protrudes from and is integrally formed with the main housing.

According to the claimed invention, the at least one port contact is a grounding contact or a power contact.

In summary, the main body, the first end portion, and the second end portion of the port contact of the present invention are an integrally-formed fork structure. Accordingly, the first end portion and the second end portion of the port contact are respectively exposed on the first face and the second face of the tongue structure of the housing base when the port contact is mounted with the housing base, such that the port connector of the present invention is capable of dually mating with a connector for enhancing convenience in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
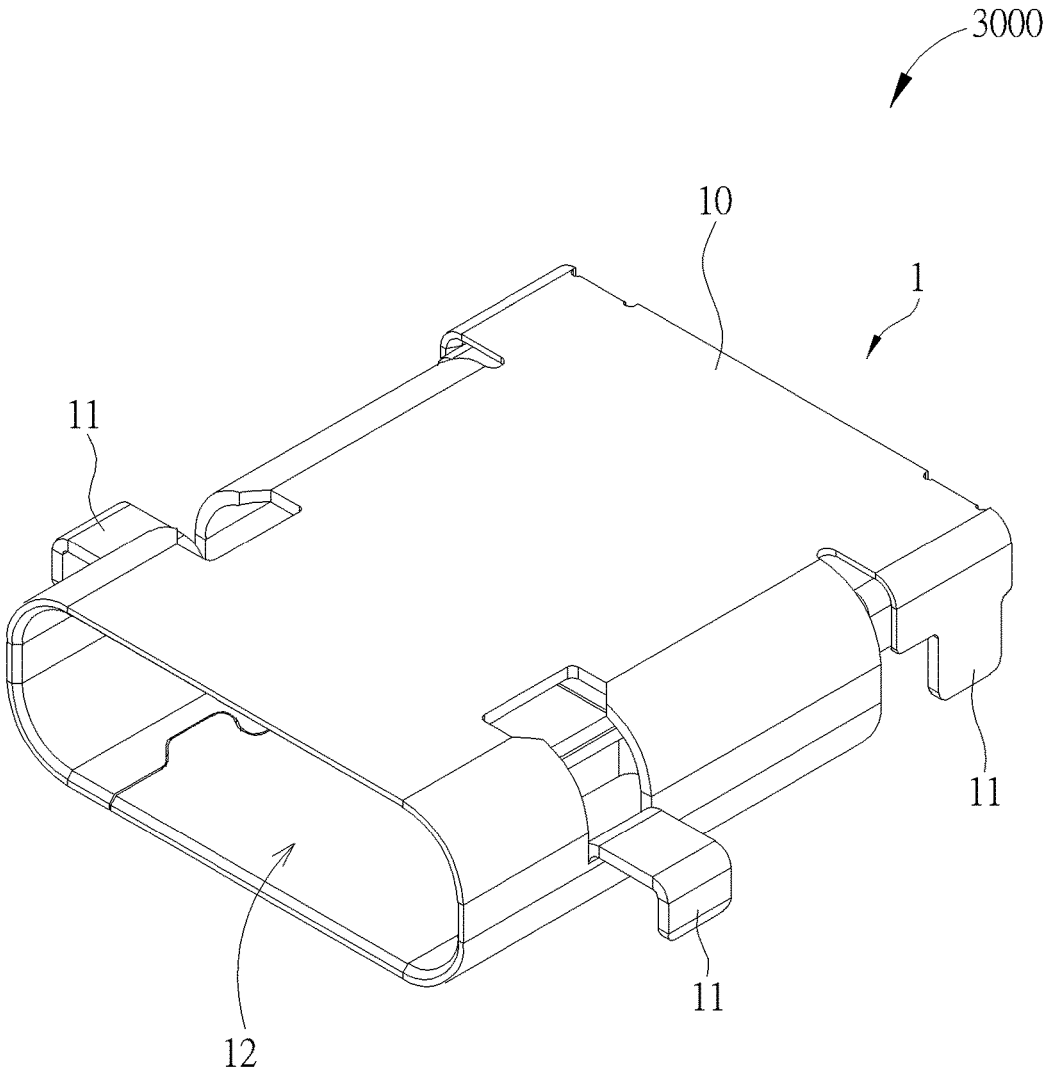
FIG. 1 is a schematic diagram of a port connector according to an embodiment of the present invention.
Figure 2:
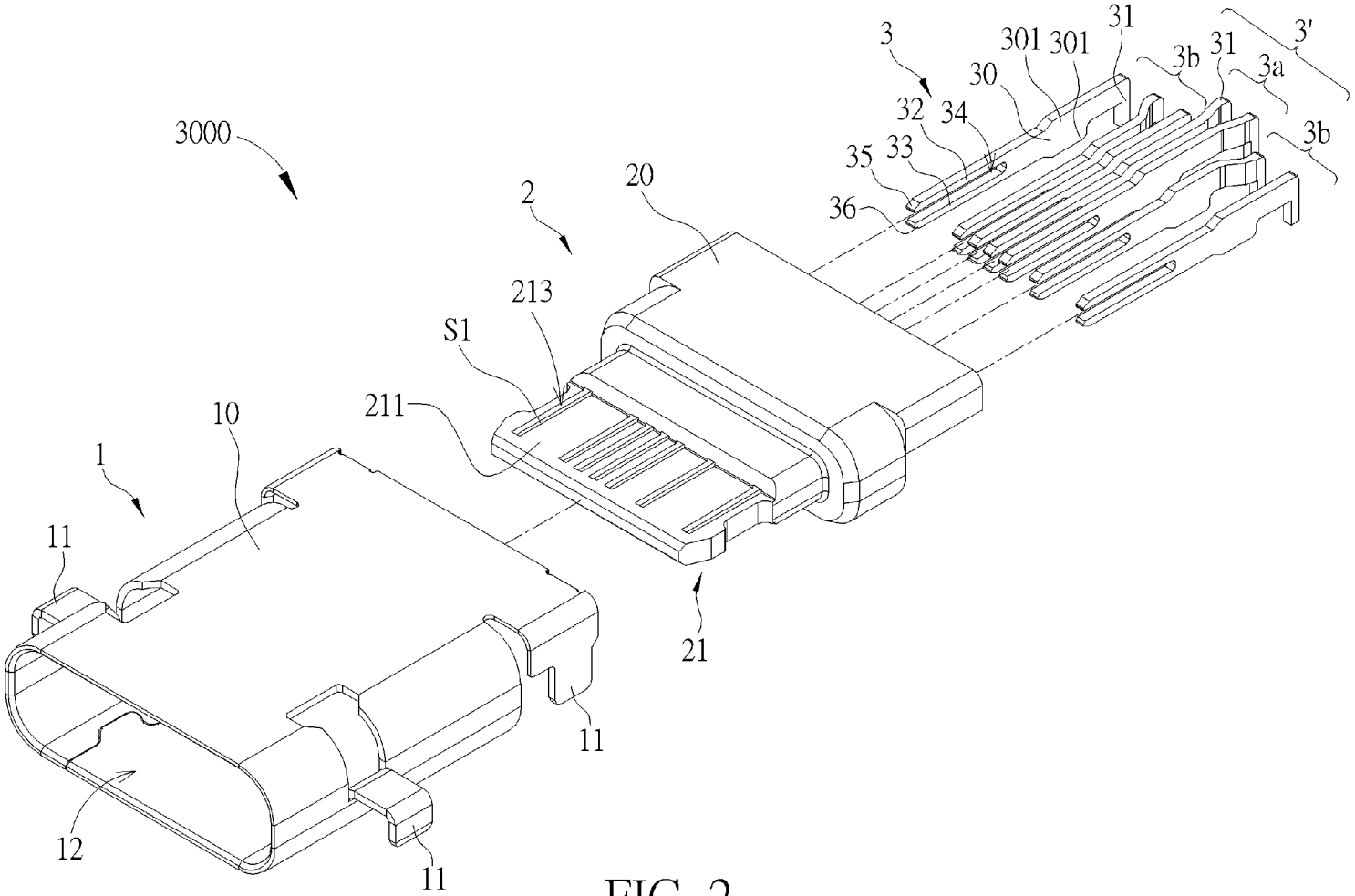
FIG. 2 is an exploded diagram of the port connector according to the embodiment of the present invention.
Figure 3:
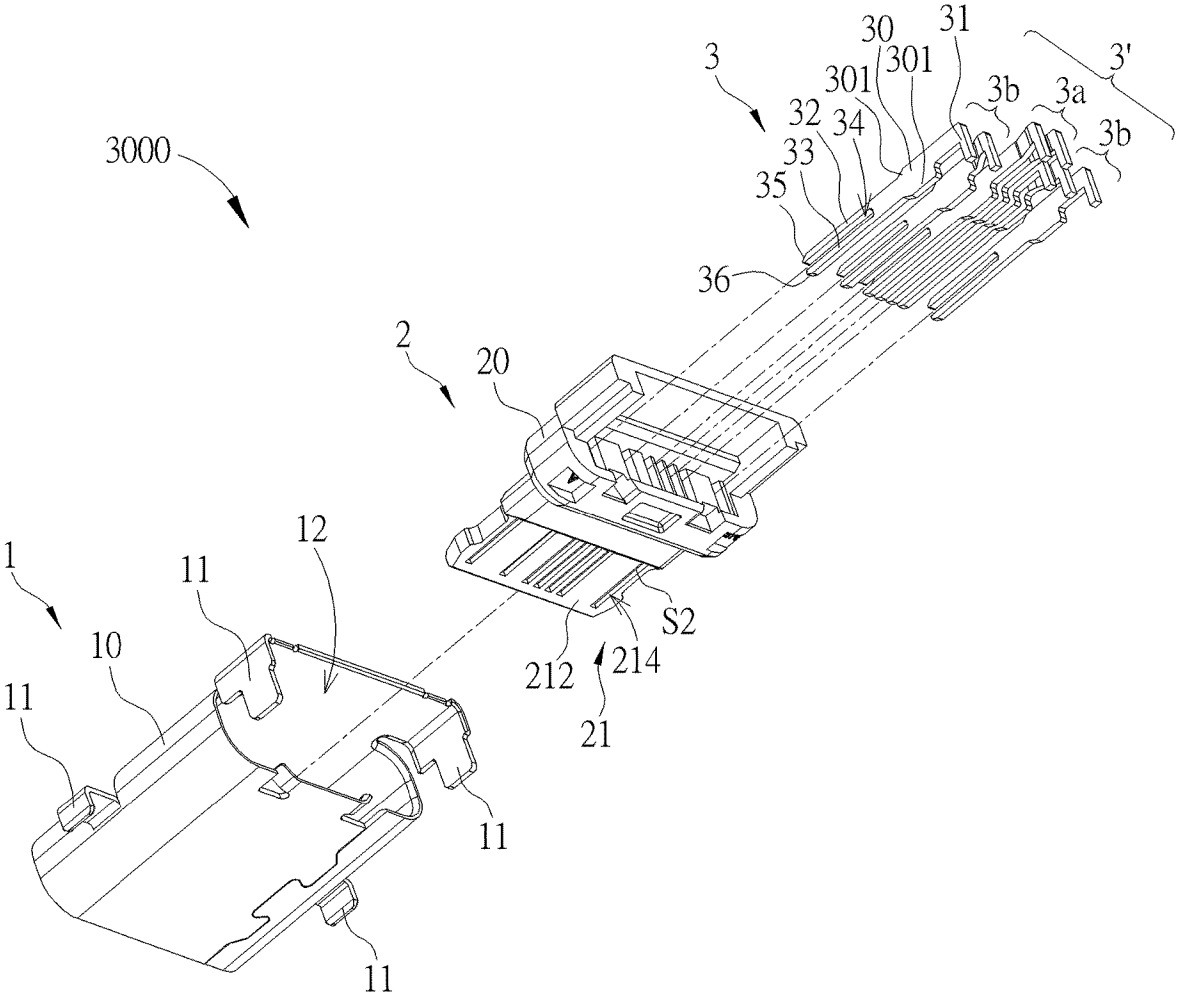
FIG. 3 is an exploded diagram of the port connector at another view according to the embodiment of the present invention.

Please refer to FIG. 1 to FIG. 3. FIG. 1 is a schematic diagram of a port connector 3000 according to an embodiment of the present invention. FIG. 2 is an exploded diagram of the port connector 3000 according to the embodiment of the present invention. FIG. 3 is an exploded diagram of the port connector 3000 at another view according to the embodiment of the present invention. As shown in FIG. 1 to FIG. 3, the port connector 3000 includes a port shell 1, a housing base 2, and a port contact set 3. The housing base 2 is disposed inside the housing base 1 and includes a main base 20 and a tongue structure 21. The tongue structure 21 extends from the main base 20 and has a first face 211 and a second face 212 opposite to the first face 211. The port contact set 3 is mounted with the housing base 2.

In this embodiment, the port contact set 3 includes seven port contacts 3', which are two grounding contacts, two power contacts, one signal detecting contact, and two signal contacts. The number and type of the port contact 3' are not limited to those illustrated in this embodiment and it depends on practical demands. Furthermore, the port contact 3' is a female contact formed by stamping, i.e., the port connector 3000 of the present invention is a female port connector. Besides, the port shell 1 is made of metal material, and the housing base 2 is made of plastic material. The housing base 2 is for fixing the port contact set 3 inside the port shell 1 and insulate each of the port contacts 3' of the port contact set 3 from the port shell 1, so as to prevent each of the port contacts 3' and the port shell 1 made of metal from being short with one another.

In addition, the port shell 1 includes a main body 10 and four fixing lugs 11. The four fixing lugs 11 protrude from the main body 11 respectively. In practical application, the fixing lug 11 is embedded on a circuit board (not shown in figures), so as to fix the main body 10, and the housing base 2 and the port contact set 3 disposed inside the main body 10 onto the circuit board. The number and configuration of the fixing lug 11 are not limited to those illustrated in figures in this embodiment. For example, the port shell 1 can only include one fixing lug 11. In other words, structures that the port shell 1 includes at least one fixing lug 11 are within the scope of the present invention. In practical application, the fixing lug 11 and the main body 10 can be integrally formed by stamping, but the present invention is not limited thereto.

Figure 4:
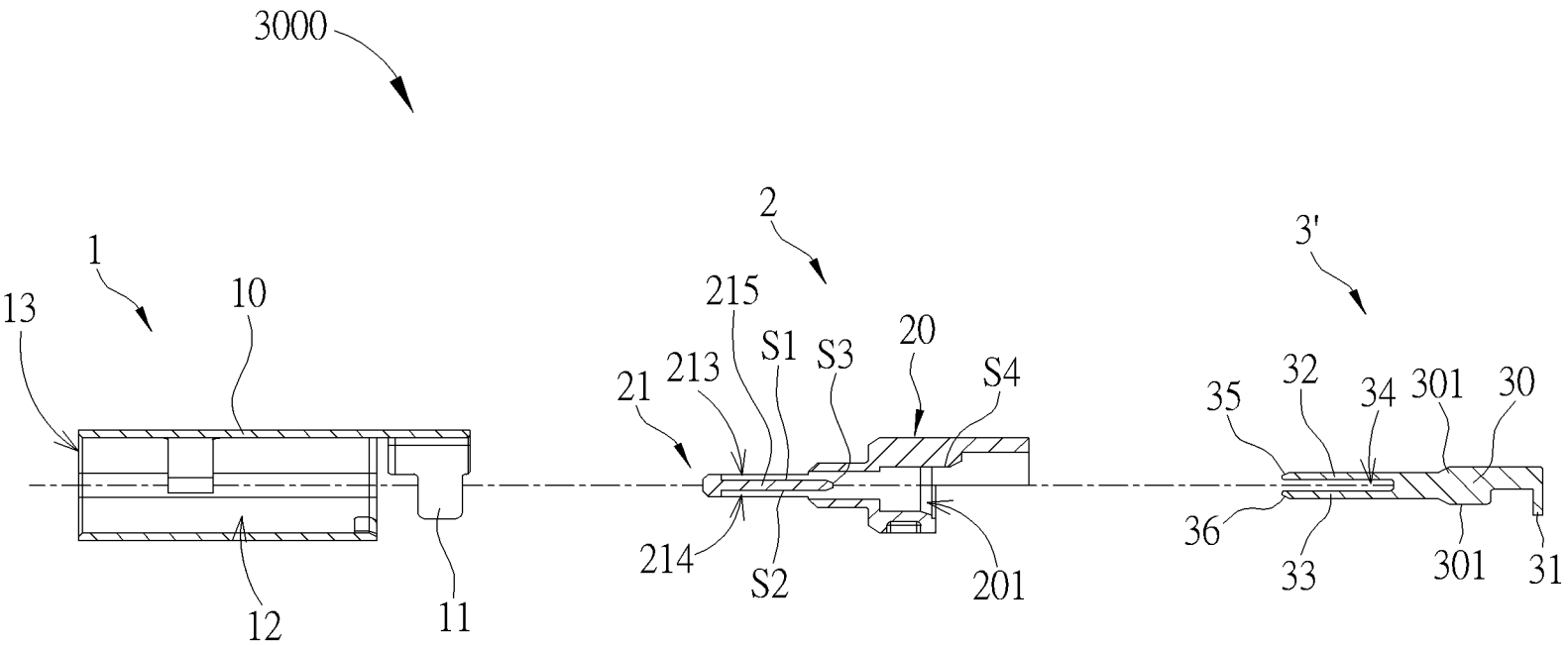
FIG. 4 is a sectional exploded diagram of the port connector according to the embodiment of the present invention.

Please refer to FIG. 2 to FIG. 4. FIG. 4 is a sectional exploded diagram of the port connector 3000 according to the embodiment of the present invention. As shown in FIG. 2 to FIG. 4, the at least one port contact 3' of the port contact set 3 includes a main body 30, a foot portion 31, a first end portion 32, and a second end portion 33. The foot portion 31 extends from the main body 30. The first end portion 32 and the second end portion 33 protrude from the main body 30, and the second end portion 33 is corresponding to the first end portion 32. Furthermore, an assembling slot 201 is formed on the main base 20 of the housing base 2. A first notch 213 is formed on the first face 211 of the tongue structure 21 of the housing base 2. A second notch 214 is formed on the second face 212 of the tongue structure 21 of the housing base 2. The assembling slot 201 communicates with the first notch 213 and the second notch 214. When each of the port contacts 3' is assembled with the housing base 2, each of the port contacts 3' is installed inside the main base 20 of the housing base 2 from the assembling slot 201 located on a rear side of the housing base 2. Accordingly, the main body 30 of the port contact 3' can be installed inside the main base 20 of the housing base 2.

Figure 5:
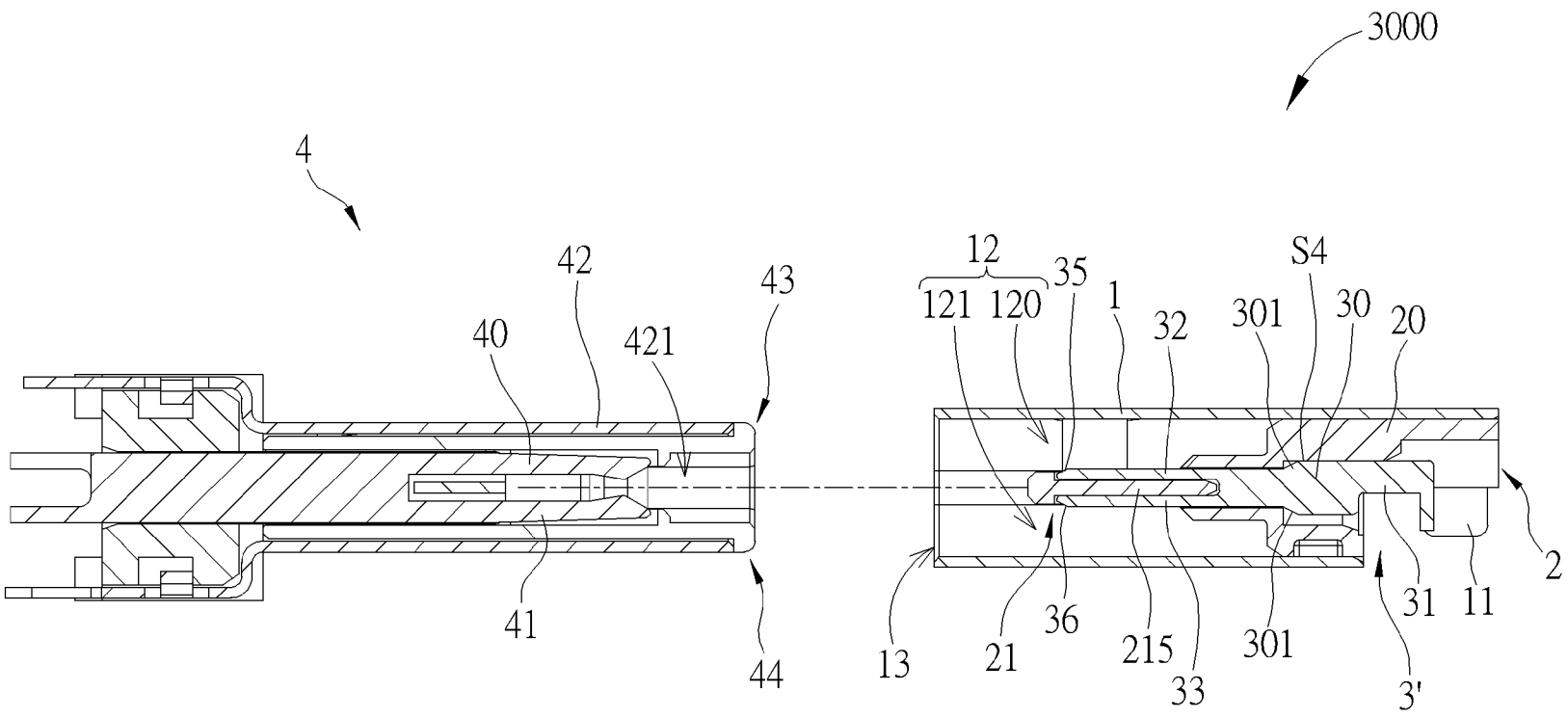
FIG. 5 is a sectional diagram of the port connector in a non-socketing status according to the embodiment of the present invention.

Please refer to FIG. 4 and FIG. 5. FIG. 5 is a sectional diagram of the port connector 3000 in a non-socketing status according to the embodiment of the present invention. As shown in FIG. 4 and FIG. 5, during the process that the main body 30 of each of the port contact 3' is installed inside the assembling slot 201 on the main base 20, the first end portion 32 of the port contact 3' can enter the first notch 213 of the tongue structure 21 via the assembling slot 201, such that the first notch 213 accommodates the first end portion 32. The second end portion 33 of the port contact 3' can enter the second notch 214 of the tongue structure 21 via the assembling slot 201, such that the second notch 214 accommodates the second end portion 33. Accordingly, the first end portion 32 is exposed on the first face 211 of the tongue portion 21 after the first end portion 32 is accommodated inside the first notch 213, and the second end portion 33 is exposed on the second face 212 of the tongue structure 21 after the second end portion 33 is accommodated inside the second notch 214. Furthermore, after the above-mentioned assembling process of the port contact 3' and the housing base 2 is completed, the foot portion 31 of the port contact 3' stretches out of the main base 20 of the housing base 2, so as to facilitate the foot portion 31 to be fixed on the circuit board by welding.

In this embodiment, the port contact set 3 includes a first port contact set **3*a* and a second port contact set 3*b*. A length of the foot portion 31 of the first port contact set 3*a* is longer than a length of the foot portion 31 of the second port contact set 3*b*, i.e., welding points where the foot portions 31 of the first port contact set 3*a* are welded and welding point where the foot portions 31 of the second port contact set 3*b* are welded are arranged in two rows. In such a way, the welding points where the foot portions 31 of the first portion contact set 3*a* are welded and the welding points where the foot portions 31 of the second contact set 3*b* are fixed on different rows of terminals on the circuit board for enhancing welding stability. Besides, the foot portion 31 of the port contact 3'** can be a dual-in-line packaged (DIP) structure, i.e., in practical application, the DIP structure (i.e., the foot portion) can be welded and fixed on the circuit board by DIP technology.

As shown in FIG. 4 and FIG. 5, the main body 30 of the port contact 3' includes two embedding structure 301 disposed on two opposite side of the main body 30. When the main body 30 is installed inside the assembling slot 201, the embedding portion 301 embeds a lateral wall S4 of the assembling slot 201. In such a way, it prevents the port contact 3' from being pushed by the plug connector 4 when a plug connector 4 mates with the port connector 3000, so as to prevent the port contact 3' from being removed from the assembling slot 201. The number and the configuration of the embedding structure 301 are not limited to those illustrated in the figures in this embodiment. For example, the main body 30 can include only one embedding structure 301 disposed at a side of the main body 30, i.e., structures that the main body 30 includes at least one embedding structure 301 and the least one embedding structure 301 is selectively disposed on a side of the main body 30 or two opposite of the main body 30 are within the scope of the present invention.

In this embodiment, the embedding structure 301 is a substantially trapezoidal structure, but structure of the embedding structure 301 is not limited thereto. For example, the embedding structure 301 can be a substantially triangular structure. As for which one of the above-mentioned designs is adopted, it depends on practical demands. Besides, a bottom face S1 of the first notch 213 and a bottom face S2 of the second notch 214 on the tongue structure 21, and a lateral wall S3 of the assembling slot 201 of the main base 20 cooperatively define a partition structure 215. A holding slot 34 is defined between the first end portion 32 and the second end portion 33. After the port contact 3' is installed inside the housing base 2, the holding slot 34 holds the partition portion 215. In such a way, the partition structure 215 is capable of providing a support for the first end portion 32 and the second end portion 33 of the port contact 3', so as to prevent that the first end portion 32 and the second end portion 33 are deformed toward the holding slot 34 when the first end portion 32 and the second end portion 33 are mated with the plug connector 4, which extends life of the port connector 3000.

Figure 6:
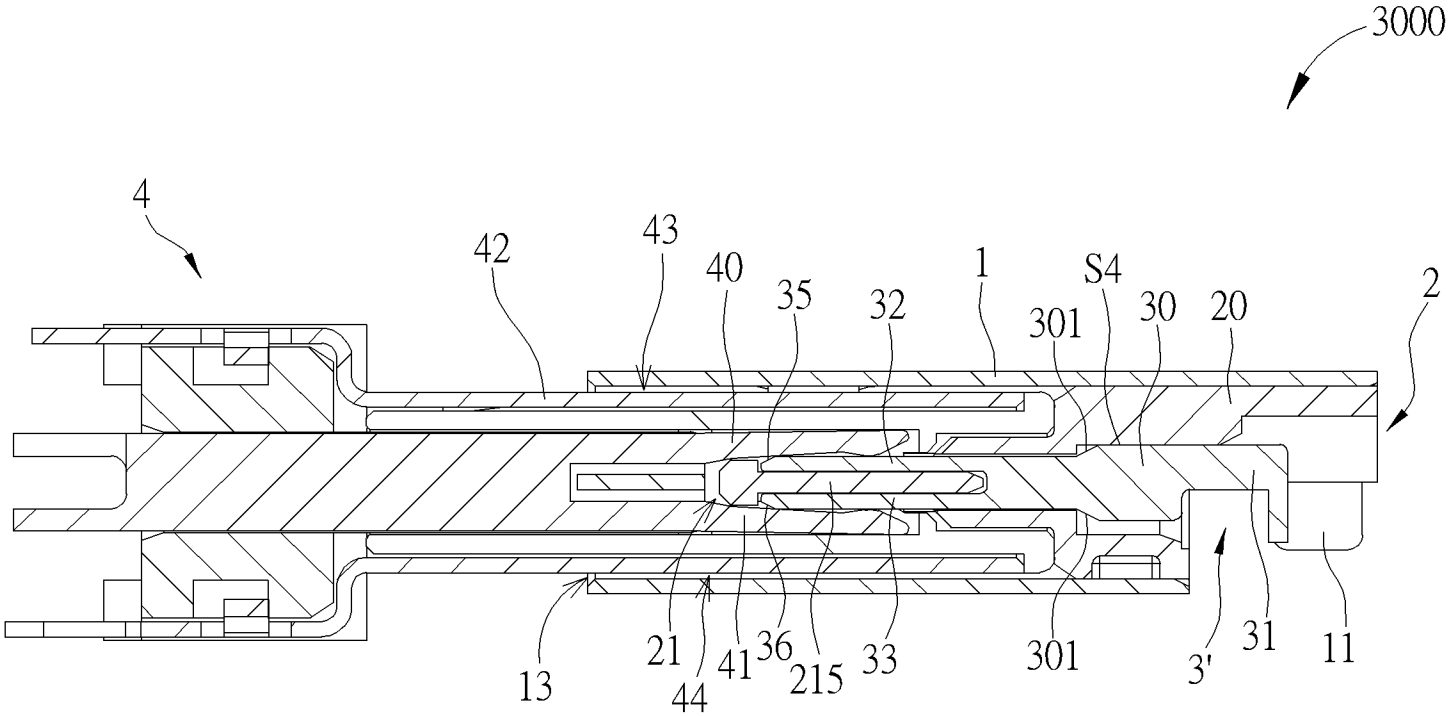
FIG. 6 is a sectional diagram of the port connector in a socketing status according to the embodiment of the present invention.

Please refer to FIG. 5 and FIG. 6. FIG. 6 is a sectional diagram of the port connector 3000 in a socketing status according to the embodiment of the present invention. As shown in FIG. 5 and FIG. 6, a chamfering structure 35 is formed on a corner of the first end portion 32 and away from the main body 30 and the second end portion 33, and a guiding structure 36 is formed on a corner of the second end portion 33 and away from the main body 30 and the first end portion 32. During the process that the plug connector 4 moves from a position shown in FIG. 5 to a position shown in FIG. 6, the chamfering structure 35 is for guiding a first plug contact 40 of the plug connector 4 from a front end of the first end portion 32 of the port contact 3', so as to ensure the first plug contact 40 to contact with the first end portion 32 smoothly and prevent that the first plug contact 40 crashes the first end portion 32 when the first plug contact 40 mates with the first end portion 32. The guiding structure 36 is for guiding a second plug contact 41 of the plug connector 4 from a front end of the second end portion 33 of the port contact 3', so as to ensure the second plug contact 41 to contact with the second end portion 33 smoothly and prevent that the second plug contact 41 crashes the second end portion 33 when the second plug contact 41 mates with the second end portion 33.

As shown in FIG. 5 and FIG. 6, an outer socketing space 12 is enclosed by the port shell 1. The housing base 2 is disposed inside the outer socketing space 12 and the outer socketing space 12 communicates with an exterior of the port shell 1 via a socketing opening 13. Accordingly, the outer socketing space 12 is able to receive a plug shell 42 of the plug connector 4. In this embodiment, the outer socketing space 12 is symmetric to the tongue 21 of the housing base 2, i.e., the tongue structure 21 of the housing base 2 is disposed at a geometry center of the plug shell 1 and splits the outer socketing space 12 into an upper socketing area 120 and a lower socketing area 121. Besides, an inner socketing space 421 is encircled by the plug shell 42. The first plug contact 40 and the second plug contact 41 are disposed inside the inner socketing space 431 and symmetric to each other.

During the process that the plug connector 4 moves from the position shown in FIG. 5 to the position shown in FIG. 6, the plug connector 4 enters into the outer socketing space 12 via the socketing opening 13, wherein a first half portion 43 of the plug connector 4 is accommodated inside the upper socketing area 120 of the outer socketing space 12, and a second half portion 44 of the plug connector 4 is accommodated inside the lower socketing area 121 of the outer socketing space 12. Meanwhile, the tongue structure 21 of the housing base 2 is inserted into the inner socketing space 421 enclosed by the plug shell 42, such that the first end portion 32 of the port contact 3' contacts with the first plug contact 40, and the second end portion 33 of the portion contact 3' contacts with the second plug contact 41.

Since the port shell 1 of the present invention is symmetric to the tongue structure 21 of the housing base 2, and the upper socketing area 120 and the lower socketing area 121 are symmetric to each other, when the plug connector 4 mates with the port connector 3000 reversely, i.e., the plug connector 4 is turned over so that the first half portion 43 is at a top side of the plug connector 4 and the second half portion 44 is at a bottom side of the plug connector 4, the upper socketing area 120 of the outer socketing space 12 of the port connector 3000 is for accommodating the second half portion 44 of the plug connector 4, and the lower socketing area 121 of the outer socketing space 12 is for accommodating the first half portion 43 of the plug connector 4, such that the plug connector 4 is able to reversely mate with the port connector 3000. In such a way, the plug connector 3000 of the present invention has capability of dual mating orientation.

It should be noted that one of the port contact 3' (e.g. the signal detecting contact) of the port contact set 3 of the port connector 3000 of the present invention is for detecting orientation that the plug connector 4 mates with the port connector 3000. The present invention further utilizes a control unit (e.g. a control chip) to configure pin definition of the port contact set 3 of the port connector 3000 for matching the orientation that the plug connector 4 mates with the port connector 3000. It should be further noted that the port contact 3' can be integrally formed and a substantially fork structure, i.e., the first end portion 32 and the second end portion 33 of the port contact 3' of the present invention can be two fork ends of the fork structure. The structural design mentioned above allows the first end portion 32 and the second end portion of the port contact 3' to be electroplated at the same time, i.e., the first end portion 32 and the second end portion 33 of the port contact 3' can be electroplated in the same electroplating process for saving manufacturing costs of the port contact 3'.

Figure 7:
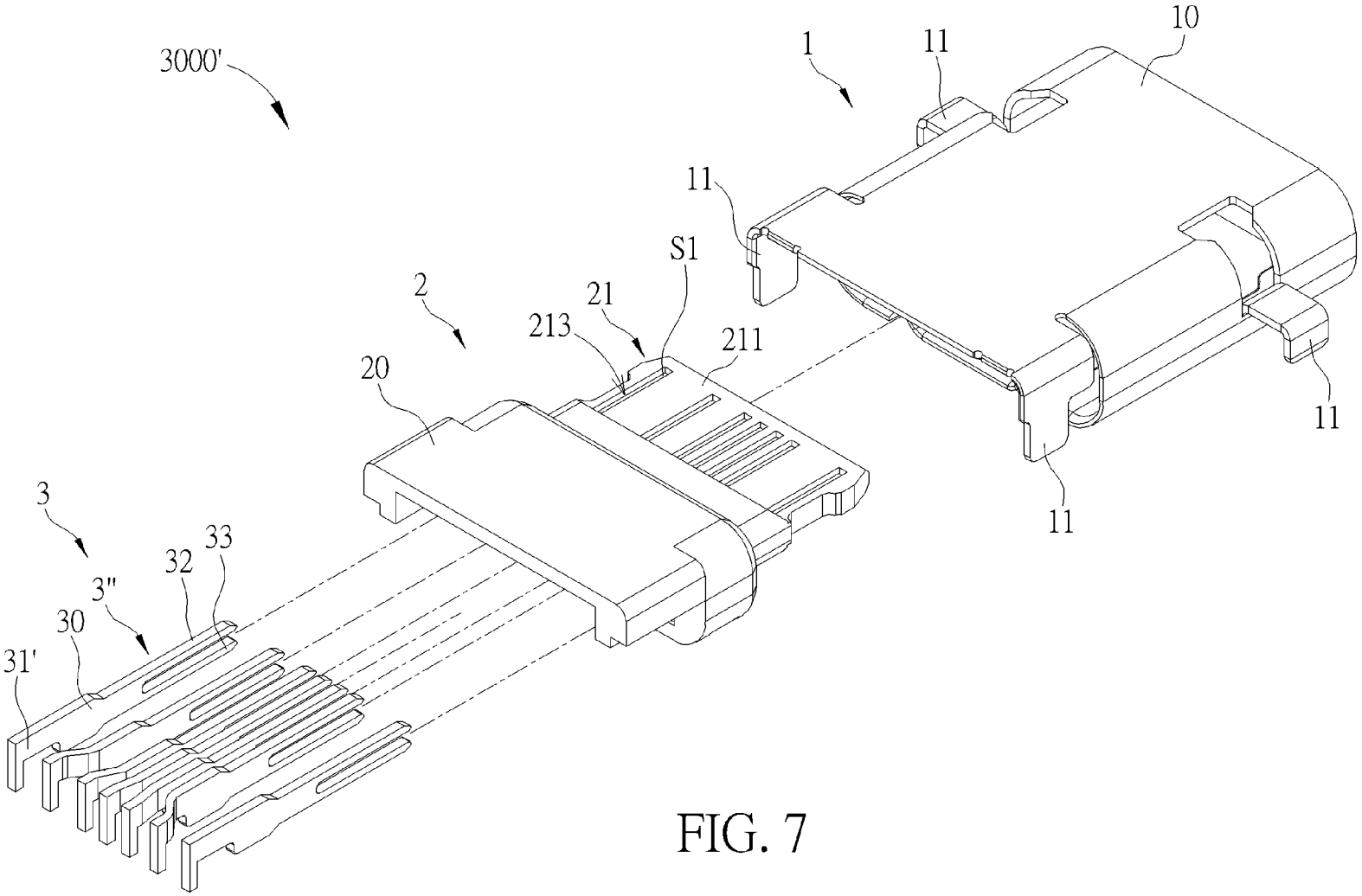
FIG. 7 is an exploded diagram of the port connector according to another embodiment of the present invention.

Please refer to FIG. 7. FIG. 7 is an exploded diagram of a port connector 3000' according to another embodiment of the present invention. As shown in FIG. 7, the main difference between the port connector 3000' and the aforesaid port connector 3000 is that lengths of the foot portions 31' of the port contact 3' of the port connector 3000' are identical, i.e., welding points where the foot portion 31' of the port contact 3' are welded are able to be arranged in the same row, such that the foot portion 31' of the port contact 3' can be fixed on terminals located in the same row on the circuit board, which ensures the welding process smoothly and saves space of the corresponding terminals on the circuit board. The elements that have the same structures and functions as that illustrated in the aforementioned embodiment are provided with the same item numbers in this embodiment, and related description is omitted herein for simplicity.

Figure 8:
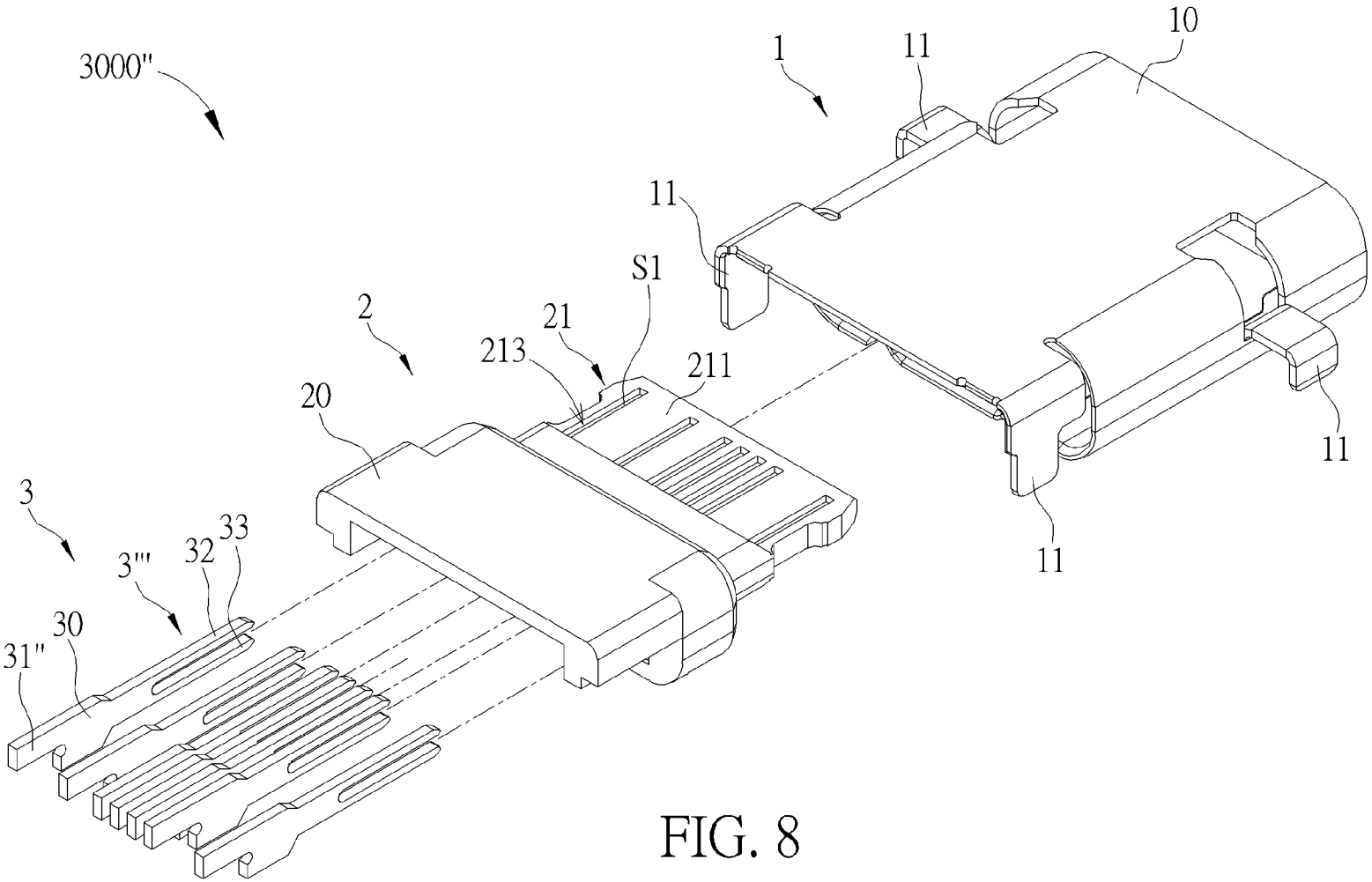
FIG. 8 is an exploded diagram of the port connector according to another embodiment of the present invention.

Please refer to FIG. 8. FIG. 8 is an exploded diagram of a port connector 3000" according to another embodiment of the present invention. As shown in FIG. 8, the main difference between the port connector 3000" and the aforesaid port connector 3000 is that a foot portion 31" of each of a port contact 3" of the port connector 3000" is a surface mounting technology (SMT) structure, i.e., in practical application, the SMT structure (i.e., the foot portion 31") can be fixed on the circuit board by SMT welding. The elements that have the same structures and functions as that illustrated in the aforementioned embodiment are provided with the same item numbers in this embodiment, and related description is omitted herein for simplicity.

Figure 9:
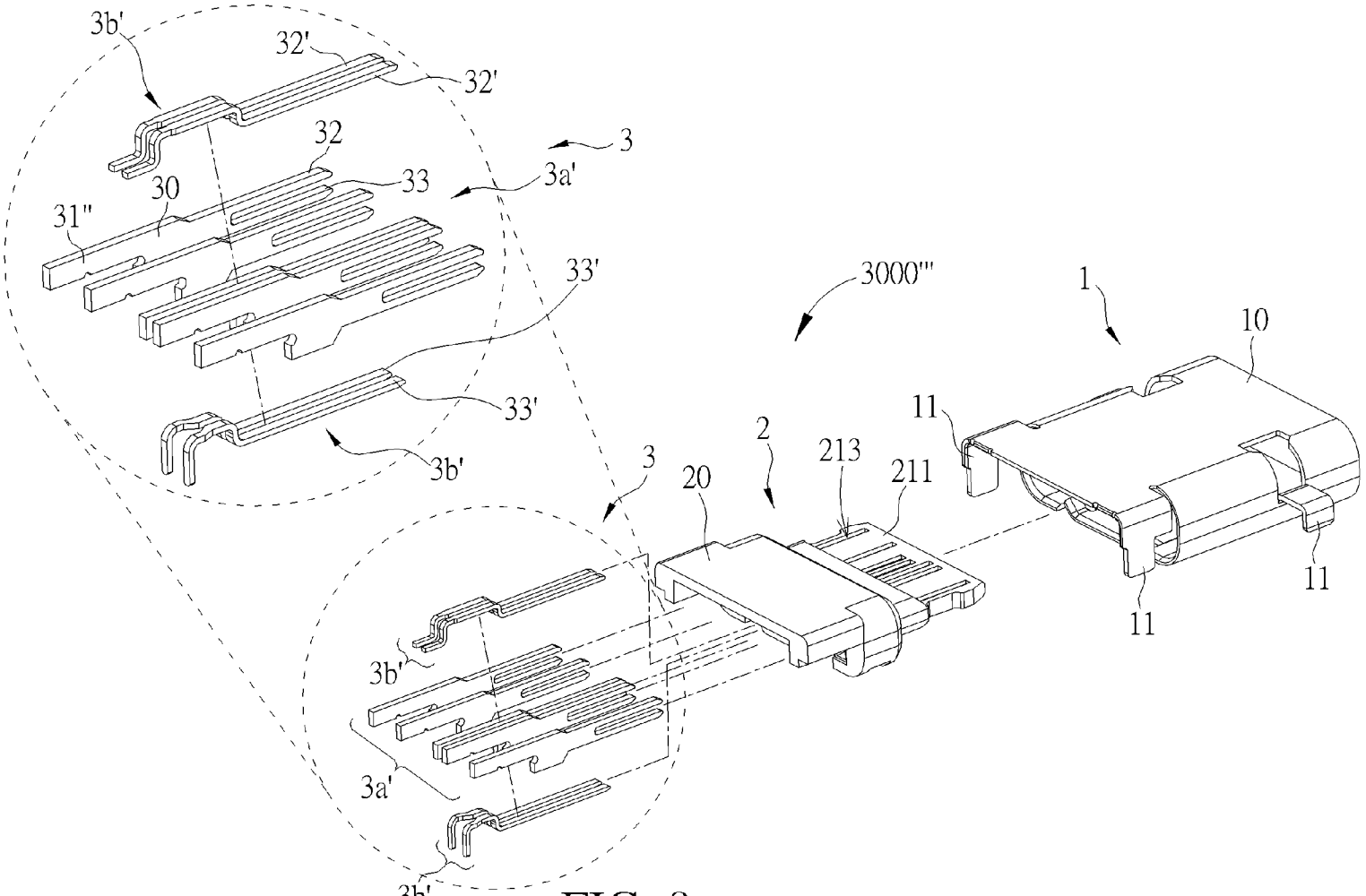
FIG. 9 is an exploded diagram of the port connector according to another embodiment of the present invention.

Please refer to FIG. 9. FIG. 9 is an exploded diagram of a port connector 3000'" according to another other embodiment of the present invention. As shown in FIG. 9, the main difference between the port connector 3000'" and the aforesaid port connector 3000 is that the port contact set 3 of the port connector 3000'" includes a first port contact set 3*a*' and a second port contact set 3*b*', wherein the first port contact set 3*a*' is a grounding contact or a power contact, and the second port contact set 3*b*' is a signal contact. In other words, in this embodiment, only the grounding contact or the power contact (i.e., the port contact 3*a*') is a integrally formed fork structure, and a first end portion 32' and a second end portion 33' of the signal contact (i.e., the port contact 3*b*') are not connected to each other. In such a way, the port connector 3000'" does not require the control unit to configure the pin definition of the port contact set 3 of the port connector 3000'", which simplifies structural design of the port connector and saves design costs. The elements that have the same structures and functions as that illustrated in the aforementioned embodiment are provided with the same item numbers in this embodiment, and related description is omitted herein for simplicity.

In contrast to the prior art, the main body, the first end portion, and the second end portion of the port contact of the present invention are an integrally-formed fork structure. Accordingly, the first end portion and the second end portion of the port contact are respectively exposed on the first face and the second face of the tongue structure of the housing base when the port contact is mounted with the housing base, such that the port connector of the present invention is capable of dually mating with a connector for enhancing convenience in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A port connector with capability of dual mating orientation, comprising:

a port shell;

a housing base disposed inside the port shell, the housing base comprising a main base and a tongue structure, the tongue structure extending from the main base and having a first face and a second face opposite to the first face; and a port contact set mounted with the housing base, at least one port contact of the port contact set comprising:

a main body installed inside the main base;

a foot portion extending from the main body and stretching out of the main base;

a first end portion protruding from the main body and being exposed on the first face; and a second end portion corresponding to the first end portion, protruding from the main body and being exposed on the second face, a front end of the first end portion being separate from a front end of the second end portion.

2. The port connector of claim 1, wherein an assembling slot is formed on the main base and for installing the main body, a first notch is formed on the first face of the tongue structure and for accommodating the first end portion, a second notch is formed on the second face of the tongue structure and for accommodating the second end portion, and the assembling slot communicates with the first notch and the second notch.

3. The port connector of claim 2, wherein a bottom face of the first notch, a bottom face of the second notch, and a lateral wall of the assembling slot cooperatively define a partition structure, a holding slot is defined between the first end portion and the second end portion, when the main body is installed inside the assembling slot, the first end portion enters into and is accommodated inside the first notch via the assembling slot, the second end portion enters into and is accommodated inside the second notch via the assembling slot, and the holding slot holds the partition structure.

4. The port connector of claim 2, wherein the main body comprises at least one embedding structure, and the at least one embedding structure embeds a lateral wall of the assembling slot when the main body is installed inside the assembling slot.

5. The port connector of claim 4, wherein the at least one embedding structure is selectively disposed on a side of the main body or on two opposite sides of the main body.

6. The port connector of claim 4, wherein the at least one embedding structure is a substantially trapezoidal structure.

7. The port connector of claim 1, wherein a chamfering structure is formed on a corner of the first end portion and away from the main body and the second end portion, and a guiding structure is formed on a corner of the second end portion and away from the main body and the first end portion.

8. The port connector of claim 1, wherein the foot portion is a dual in-line packaged structure or a surfaced mounted structure.

9. The port connector of claim 1, wherein the port contact set comprises a first port contact and a second port contact, and a length of a foot portion of the first port contact is longer than a length of a foot portion of the second port contact.

10. The port connector of claim 1, wherein the port shell comprises a main housing and at least one fixing lug, and the at least one fixing lug protrudes from and is integrally formed with the main housing.

11. The port connector of claim 1, wherein the at least one port contact is a grounding contact or a power contact.

* * * * *